United States Patent [19]

Nee

[11] Patent Number: 4,673,467

[45] Date of Patent: Jun. 16, 1987

[54] METHOD OF MANUFACTURING FINE-GRAINED COPPER SUBSTRATE FOR OPTICAL INFORMATION CARRIER

[75] Inventor: Hanphire H. Nee, Stamford, Conn.

[73] Assignee: CBS Inc., New York, N.Y.

[21] Appl. No.: 902,845

[22] Filed: Sep. 2, 1986

[51] Int. Cl.[4] ..... C25D 3/38; C25D 7/00

[52] U.S. Cl. ..... 204/23; 204/1 T; 204/52.1; 436/98

[58] Field of Search ..... 204/52.1, 23

[56] References Cited

U.S. PATENT DOCUMENTS

| | | | |
|---|---|---|---|
| 3,267,010 | 8/1966 | Creutz et al. | 204/52.1 |
| 4,334,966 | 6/1982 | Beach et al. | 204/25 |
| 4,512,007 | 4/1985 | Knothe et al. | 369/127 |

*Primary Examiner*—G. L. Kaplan

*Attorney, Agent, or Firm*—Lewis H. Eslinger; Spencer E. Olson

[57] ABSTRACT

A method is provided for depositing on a substrate a layer of fine-grained copper especially adapted for the making of masters for optical information storage discs, comprising the steps of placing a substrate in an electroplating bath comprising from about 180 to about 220 grams/liter of copper sulfate, from about 40 to about 80 grams/liter of sulfuric acid, from about 30 to about 60 ppm of chloride ion, from about 1.0 to about 15 grams/-liter of a polyether having a molecular weight from about 4,000 to about 10,000, from about 1.0 to about 100 milligrams/liter of a sulfonated, sulfurized benzene compound, and from about 3.5 to about 30 milligrams/-liter of 1-lower alkyl-2-mercapto imidazole; and passing electric current through the bath to deposit copper on the substrate. Also disclosed is a method of using high performance liquid chromatography techniques to quantitatively measure 1-lower alkyl-2-mercapto imidazole concentration and to control the same.

6 Claims, 2 Drawing Figures

METHOD OF MANUFACTURING FINE-GRAINED COPPER SUBSTRATE FOR OPTICAL INFORMATION CARRIER

BACKGROUND OF THE INVENTION

This invention relates to a method of electroplating fine-grained copper suitable for the mastering of optical information storage discs and, more particularly, to a method for measuring and controlling the concentration of an organic compound in the copper electroplating bath to achieve the desired microstructure and microhardness of the copper.

Commonly-assigned patent application Ser. No. 863,905 filed May 16, 1986, by applicant and Vasil D. Tasi describes a process for manufacturing a master for the replication of an optical information carrier in which a layer of fine-grained copper is coated with a photoresist and exposed by a laser beam which is turned on and off in accordance with information to be recorded on the carrier. After developing the photoresist, the exposed portions of the copper layer are etched to a predetermined depth and the photoresist then stripped from the etched copper surface. The result is a copper master on which the information is stored as discrete pits along a spiral information track having a pitch of the order of 1.6 microns. The track width (i.e., the width of the pits) is 0.6 micron, the pits range in length from 0.6 to 0.9 micron, and the pit depth is $0.12 \pm 0.01$ micron. Of paramount importance to the success of this process is that the grain-size of the copper layer be substantially smaller than the size of the information pits, namely, much smaller than 0.6 to 0.9 micron. Experience has shown it necessary to make the copper microstructure "amorphous", meaning that the grain size be smaller than an optical microscope can resolve, while maintaining a Knoop microhardness higher than about 210 at 100 grams load. In order to electroplate a layer of copper having these properties, quantitative measurement and control of organic brightener concentration in the copper plating bath are essential.

U.S. Pat. No. 3,267,010 describes a process for the electrodeposition of copper from aqueous acidic baths, especially from acidic copper sulfate and fluoborate baths, in which certain organic compounds are used in the bath which make possible bright, highly ductile copper deposits. This process, if modified by increasing the brightener concentration and/or the plating temperture, will produce copper with sufficient hardness, but both of these process parameters promote decomposition of the organic brighteners, which necessitates frequent carbon treatment to remove the decomposed brighteners from the plating bath. Another problem associated with this prior brightener system, which makes it unsuitable for electroplating copper having the aforementioned "amorphous" microstructure, is that it is very difficult to quantitatively measure the organic compounds that are responsible for modifying the microstructure of copper.

Of the commercially available bright acid copper plating systems known to applicant, none can produce copper with adequate microhardness nor an "amorphous" structure. For example, the plating system described in U.S. Pat. No. 4,334,966 for applying to a gravure cylinder a plating of copper especially adapted to receive electronic engraving, is incapable of producing an amorphous grain structure and a Knoop microhardness of 210 or more. The described plating bath using 200 grams/liter of the copper sulfate composition, 60 grams/liter of sulfuric acid, 3.0 grams/liter of polyether having a molecular weight of about 8,000, 3.0 milligrams/liter of 1-lower alkyl-2-mercapto imidazole, and 1.0 to 100 milligrams/liter of a sulfonated, sulfurized benzene compound, produced a copper plating that was not sufficiently stable in its microstructure to withstand a bake-out or drying treatment commonly used to dry a substrate prior to application of photoresist. Furthermore, the patent does not describe any method for quantitatively controlling concentration of the imidazole compound in the plating bath for production use.

SUMMARY OF THE INVENTION

In one aspect, the present invention concerns a method of depositing on a suitable metal substrate a layer of copper especially adapted for the manufacture of information storage discs comprising the steps of placing a substrate in an electroplating bath comprising from about 180 to 220 grams/liter of copper sulfate pentahydrate, from about 40 to about 80 grams/liter of sulfuric acid, from about 30 to about 60 parts per million of chloride ion, from about 1.0 to about 15 grams/liter of a polyether having a molecular weight from about 4,000 to about 10,000, from about 3.5 to about 30 milligrams/liter of 1-lower alkyl-2-mercapto imidazole, and from about 1.0 to about 100 milligrams/liter of a sulfonated, sulfurized benzene compound; and passing electric current through the bath to deposit copper on the substrate. The imidazole ingredient controls the grain structure of the electroplated copper to make it amorphous.

In another aspect, the present invention relates to a technique for quantitatively measuring and controlling the concentration of the imidazole ingredient in the plating bath and consequently the grain structure and hardness of the plated copper. A high performance liquid chromatograph is used to perform the analysis, which is achieved by injecting a controlled volume of the bath solution into the column along with a solvent comprising an aqueous solution of acetonitrile at a predetermined rate.

DESCRIPTION OF THE PREFERRED PRACTICE OF THE INVENTION

Figure 2:
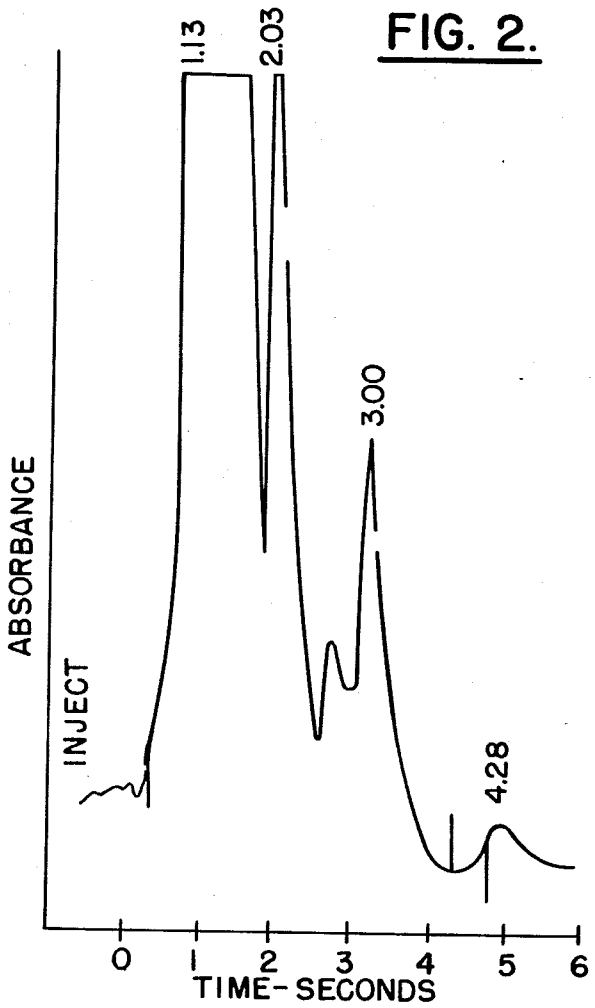
FIG. 2 is a chromatogram of the plating bath according to the invention after operation for three months without carbon treatment.

For making a master for the replication of optical discs, a layer of copper is deposited on a suitable substrate formed of a metal such as copper, aluminum or stainless steel. After suitable surface treatment, the substrate disc is electroplated with copper from a bath formed by combining with a solution containing from about 180 to about 220 grams/liter of copper sulfate pentahydrate ($CuSO_4.5H_2O$) and from about 40 to about 80 grams/liter of sulfuric acid and a small quantity of chloride ion in the range from about 30 to about 60 parts per million, an additive consisting essentially of a polyether, a quantity of 1-lower alkyl-2-mercapto imidazole and a sulfurized, sulfonated benzene compound.

The polyether is desirably a polyethylene oxide material having a molecular weight in the range from about 4,000 to 10,000, and as little as 1 gram/liter in the bath is effective and as much as 15 grams/liter may be used. Suitable polyether compounds are disclosed in U.S. Pat. No. 4,334,966. The ingredient for controlling grain-structure in the copper deposit, the concentration of which is an essential feature of this invention, is 1-lower alkyl-2-mercapto imidazole. Applicant has found that a concentration of from about 3.5 to about 30 milligrams/liter, approximately ten times the concentration used in the bath described in U.S. Pat. No. 4,334,966, for copper plating gravure cylinders, is necessary to ensure a stable copper grain structure that will remain amorphous during thermal processing of the substrate prior to application of the photoresist. A preferred amount in the bath is about 7.0 milligrams/liter. As used herein, the term "lower alkyl" means alkyl groups having from one to four carbon atoms, such as methyl, ethyl, n-propyl, isopropyl, n-butyl, iso butyl, secondary butyl and tertiary butyl.

A sulfurized, sulfonated benzene compound such as discussed in U.S. Pat. No. 4,334,966 is used as a brightener and is employed in the bath in a range from about 1.0 to about 100 milligrams/liter.

The plating is applied to the substrate with the plating bath at a temperature ranging from about 20° C. to about 35° C., preferably at about 30° C. Current density may be from about 50 to about 70 A/sq.ft., preferably about 60 A/sq.ft. During plating the disc-shaped substrate is immersed and rotated in the plating bath, and at the same time the bath solution is agitated by pumping filtered solution onto the rotating part. Plating is continued until the deposit has a thickness in the range from 5 microinches to 0.025 inch. With suitable adjustment of the level of the solution and the amount of agitation, a copper layer of uniform thickness, typically having a Knoop microhardness of about 210 to about 280 at 100 grams load, can be obtained. Uniformity of the thickness of the deposit promotes uniform brightener concentration in the copper which, in turn, insures that the copper layer has the required uniformity to respond uniformly to the critical etching step in the manufacture of an optical disc master.

Because the microstructure of the plated copper is critically dependent on the concentration of the 1-lower alkyl-2-mercapto-imidazole, it is essential to the success of the plating process to be able quantitatively to measure and control its concentration in the bath. An important aspect of the present invention is the provision of a high-performance liquid chromatography (HPLC) technique for making the analysis. Suitable apparatus for performing the analysis is a high performance liquid chromatograph and a radial pack C18 column, both commercially available from Waters Associates of Milford, Massachusetts. The wavelength of the ultraviolet spectrophotometer is set at about 235 to 255 nanoseconds so as to detect organic species. Applicant has discovered that a mobile phase or solvent formed by combining about 1% to about 30% acetonitrile and 70% to 99% water, preferably 10% acetonitrile and 90% water, is particularly suitable for the detection of the imidazole compound. Following injection into the column of a fixed volume test sample, this solvent is pumped through the column at a rate of about 1.0 to about 5 milliliters/minute, preferably at 3 milliliters/minute.

Figure 1:
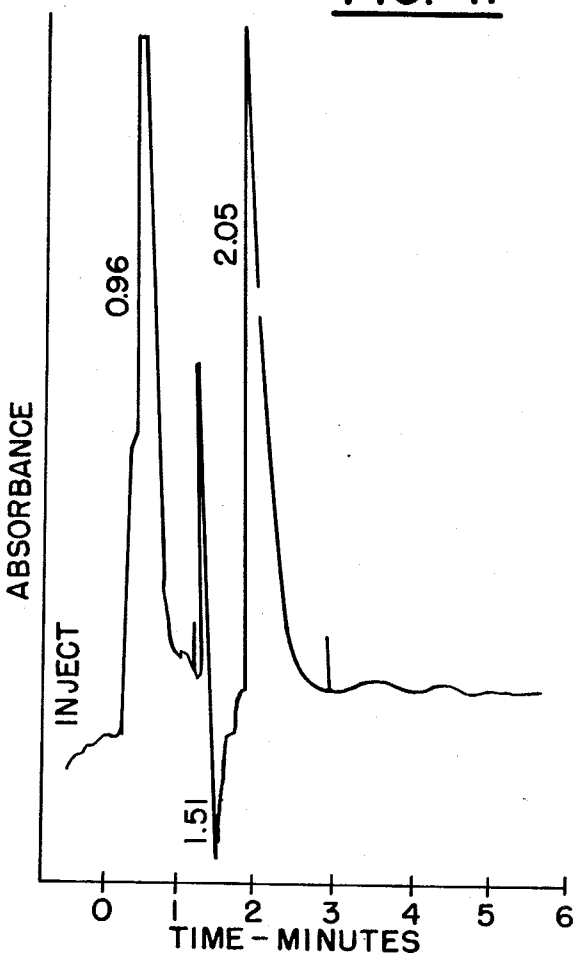
FIG. 1 is a chromatogram of 1-methyl-2-mercapto-imidazole in deionized water.

For purposes of establishing a frame of reference for subsequent measurement of samples of the plating bath, the chromatogram of FIG. 1 was obtained on a 60 microliter injected sample containing 3.0 milligrams/liter of the imidazole compound in dionized water, with a solvent composition of 10% acetonitrile and 90% water and a flow rate of 3.0 milliliters per minute, and the spectrophotometer wavelength set at 245 nanometers. The retention time of 2.05 minutes identifies the imidazole peak, and the area under this retention time peak is proportional to the concentration of the imidazole compound.

FIG. 2 is a chromatogram obtained on a 60 microliter injected sample of production plating bath containing 3.8 milligrams/liter of the imidazole compound, using the same solvent and flow rate and spectrophotometer setting, which shows a retention time of 2.03 minutes for the compound. Typical measurement errors, as defined by standard deviation of two duplicate runs divided by the average, range from about 3% to 7%.

Using this analytical technique, a calibration curve can be constructed by making a series of runs of known concentration of the 1-lower alkyl-2-mercapto imidazole compound. A plot of absorbance of the compound versus concentration, commonly known as the "Beer's Law", can be constructed. Any unknown concentration can be determined by knowing the absorbance value of the compound and by either interpolation or extrapolation from the calibration curve. Once the concentration of 1-lower alkyl-2-mercapto imidazole in the bath is known, the necessary addition to restore its concentration to a desired value can easily be made.

After electroplating the copper to a desired thickness, the copper surface is machined and polished to an optical finish, properly cleaned and dehydrated, coated with a layer of photoresist, exposed with a laser or an ultraviolet light source with the desired information pattern and developed to remove the exposed areas of photoresist. Thereafter the surface is chemically etched so that the information pattern in the photoresist is transferred to the copper. The resulting etched copper substrate is used as a master for making optical information storage discs.

EXAMPLE I

A plating bath was prepared containing 200 grams/liter of copper sulfate, 60 grams/liter of sulfuric acid, 50 ppm of chloride ion, 3.5 milligrams/liter of 1-methyl-2-mercapto imidazole, 3.0 grams/liter of polyethylene glycol, 1.0 to about 100 milligrams/liter of sulfonated, sulfurized benzene compound. A copper substrate was plated at 30° C. at 60 A/sq.ft. to produce a deposit, 0.005 inch thick, which had a Knoop microhardness of 220 at 100 grams load. The copper plated substrate was machined and polished flat, dehydrated at 200° C. for one-half hour, coated with photoresist, laser exposed, developed and etched in a pyrophosphate bath. The shape and size of the resulting pits were examined by a scanning electron microscope and found satisfactory for the optical disc application. The stability of the copper microstructure after the dehydration treatment, and before the etching treatment, was found to be acceptable. Its life at room temperature, for the optical disc application, was about one week.

EXAMPLE II

Using the plating bath and plating conditions of EXAMPLE I, except that the concentration of the 1-methyl-2-mercapto imidazole was increased to 7.0 milligrams/liter, produced a copper surface the stability of the microstructure of which was excellent at room temperature after dehydration treatment.

While the foregoing describes the use of a fine-grained copper layer for manufacturing masters for optical information storage discs, it will be recognized and understood that the method is equally applicable to other applications requiring a fine-grained copper surface, such as masters for phonograph records, masters for capacitance pick-up electronic discs and diamond-turned infrared mirrors.

Although the invention has been described in detail with reference to presently preferred embodiments, various modifications can now be made by one of ordinary skill in the art without departing from the spirit and scope of the invention. Accordingly, it is intended that the invention be limited only by the appended claims.

I claim:

1. A method of depositing on a disc-shaped substrate a layer of copper for mastering an optical storage disc comprising the steps of placing the substrate in an electroplating bath comprising from about 180 to about 220 grams/liter of copper sulfate pentahydrate, from about 40 to about 80 grams/liter of sulfuric acid, from about 30 to about 60 part per million of chloride ion, from about 1.0 to about 15 grams/liter of polyether having a molecular weight from about 4000 to about 10,000, from about 3.5 to about 30.0 milligrams/liter of 1-lower alkyl-2-mercapto-imidazole, and from about 1 to about 100 milligrams/liter of sulfonated, sulfurized benzene compound; and passing electric current through the bath.

2. A process according to claim 1, wherein the lower alkyl of the imidazole compound is selected from the group including methyl, ethyl, n-propyl, isopropyl, n-butyl, isobutyl, secondary butyl and tertiary butyl.

3. A process according to claim 1, wherein the lower alkyl of the imidazole compound is methyl.

4. A process according to claim 1, wherein the bath contains about 7.0 milligrams/liter of the imidazole compound.

5. A process according to claim 1, wherein the bath is operated at a temperature in the range of from about 20° C. to about 35° C.

6. A process according to claim 1, wherein an electric current from about 50 amperes/square foot to about 70 amperes/square foot is passed through said bath to deposit on said substrate a layer of copper from 5.0 microinches to 0.025 inch thick.

* * * * *